United States Patent [19]

Meyer et al.

[11] Patent Number: 4,570,326

[45] Date of Patent: Feb. 18, 1986

[54] CABLE HARNESS ASSEMBLY APPARATUS

[75] Inventors: David L. Meyer; Brian A. Wolfe, both of Jonestown, Pa.

[73] Assignee: AMP Incorporated, Harrisburg, Pa.

[21] Appl. No.: 555,327

[22] Filed: Nov. 25, 1983

[51] Int. Cl.[4] ..... H01R 43/04

[52] U.S. Cl. ..... 29/566.3; 29/749

[58] Field of Search ..... 29/566.1, 566.3, 566.4, 29/749, 33 K, 33 M

[56] References Cited

U.S. PATENT DOCUMENTS 4,020,540 5/1977 Casciotti et al. ..... 29/749
4,110,880 9/1978 Peppler et al. ..... 29/749
4,148,130 4/1979 Stauffer et al. ..... 29/566.3
4,359,257 11/1982 Lopinski et al. ..... 339/99 R

*Primary Examiner*—Gil Weidenfeld
*Assistant Examiner*—Daniel W. Howell

[57] ABSTRACT

A cable harness assembly apparatus has a press assembly defining a workstation and an index frame assembly moveable transversely through the workstation. A plurality of connector receiving fixtures are adjustably spaced along the index frame with a plurality of cable clamping fixtures interspersed with the connector carrying fixtures. At least one of the connector carrying fixtures is provided with cable cutting means which, when actuated, sever the cable simultaneously with termination thereof by the last connector of the harness.

13 Claims, 7 Drawing Figures

CABLE HARNESS ASSEMBLY APPARATUS

The present invention relates to an apparatus for preparing cable harnesses formed by a plurality of individual electric connectors making appropriate terminations of a multiple conductor flat cable and in particular to an apparatus which will cut the cable upon effecting the final termination.

There are a number of cable harness assembly machines which are available, each of which performs a specific series of functions. For example, U.S. Pat. No. 4,148,130 discloses a cable harness assembly apparatus which will specifically straighten the cable prior to effecting the termination. The termination is accomplished in a two step operation with the connector being applied first from one side of the cable and then the cable is inverted and the cover applied from the opposite side of the cable.

The present invention represents somewhat of an improvement over the above apparatus in that it has a single step termination made possible by utilizing electrical connectors of the type disclosed in U.S. Pat. No. 4,359,257, the disclosure of which is incorporated herein by reference.

The subject apparatus includes a press assembly having a ram carrying on one end thereof a tool compatible with the electrical connectors and means to actuate the ram. An indexing frame is provided for linear movement transversely of the press so as to sequentially position a plurality of connector supporting assemblies beneath the ram. One of the connector supporting assemblies includes means which, when actuated, will cause the cable to be cut adjacent the last terminated connector.

A preferred embodiment of the present invention will now be described with reference to the accompanying drawings in which.

Figure 1:
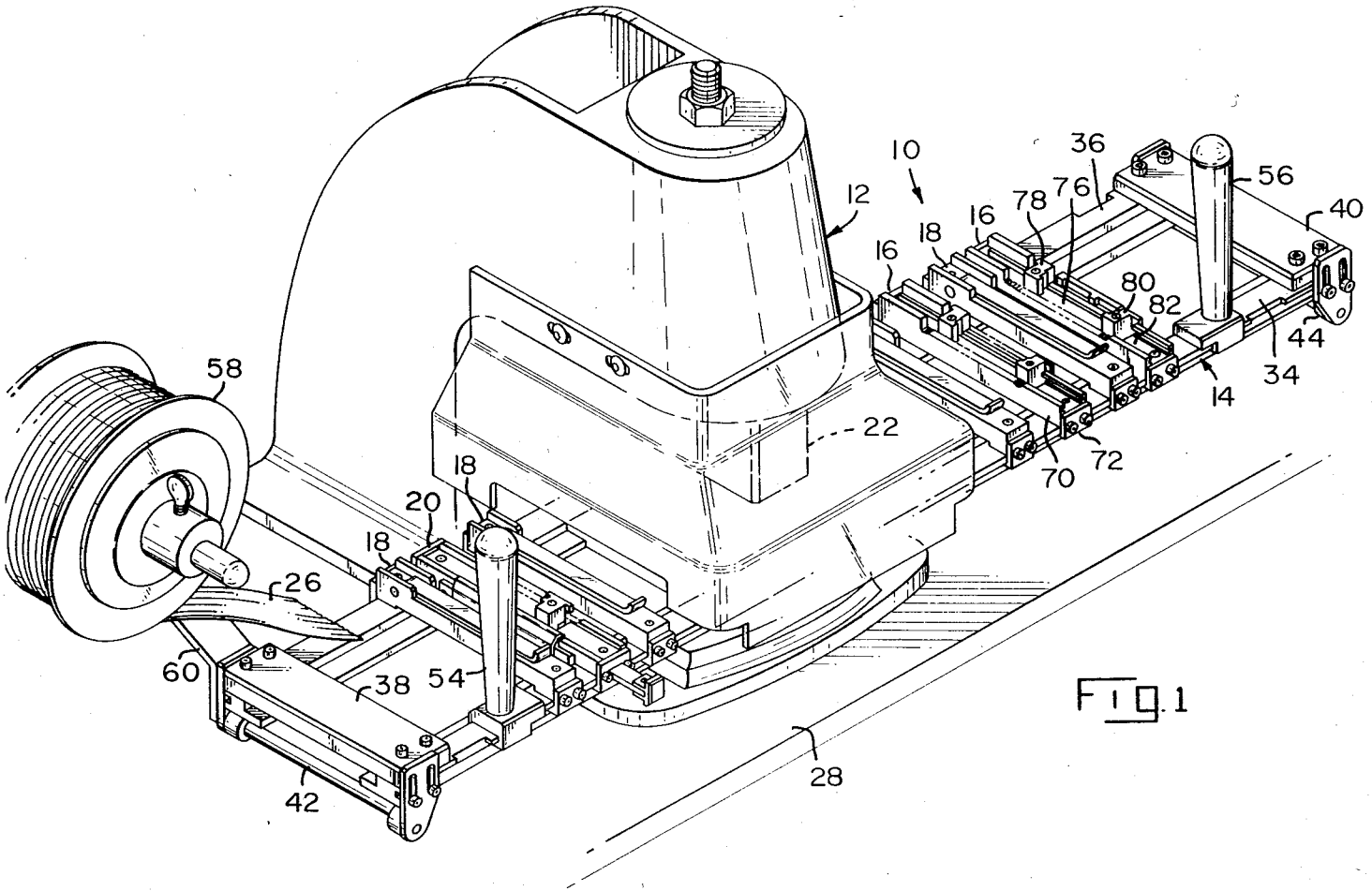
FIG. 1 is a perspective view of an apparatus according to the present invention.
Figure 2:
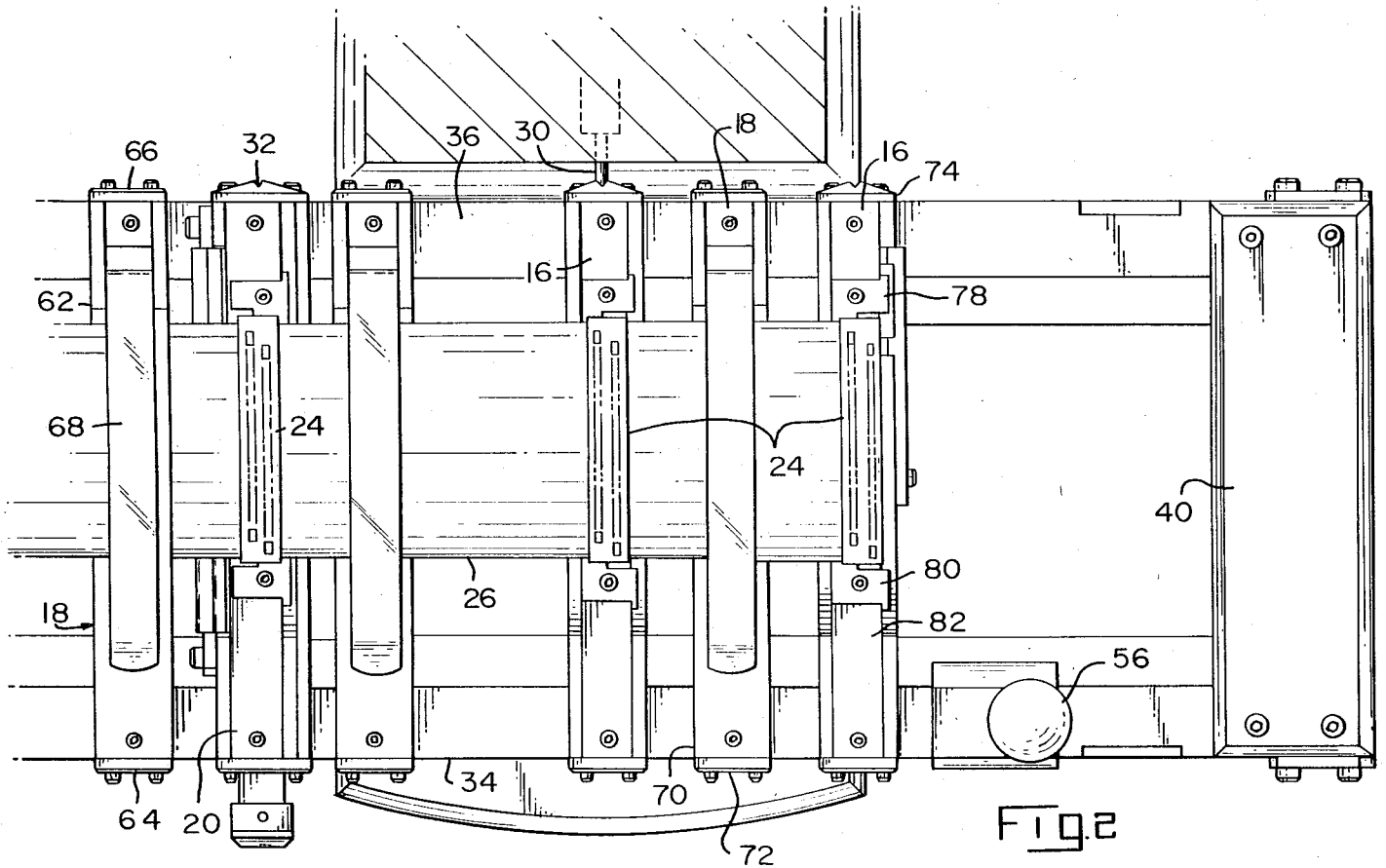
FIG. 2 is a top plan view of the leading end of the index frame.

The subject apparatus 10 includes a press assembly 12 and an index frame 14 having a plurality of connector carrying fixtures 16 secured thereon with cable clamping fixtures 18 between respective pairs of connector carrying fixtures 16. One of the connector carrying fixtures 20 is also provided with a cable cutting mechanism, which will be described in detail later. The press assembly 12 is of a well known configuration and has a vertically actuated ram 22 which is driven by known mechanical, hydraulic or pneumatic means (not shown) to apply force to a connector 24 to effect termination with a multi conductor, flat cable 26 and assembly of the connector 24 as described in the above-mentioned U.S. Pat. No. 4,359,257. The press assembly 12 is preferably mounted on a flat surface 28 and includes an aligning pin means 30 (See FIG. 2) positioned relative to the ram and engaging in respective detents 32 of the fixtures 16 and 20.

Figure 3:
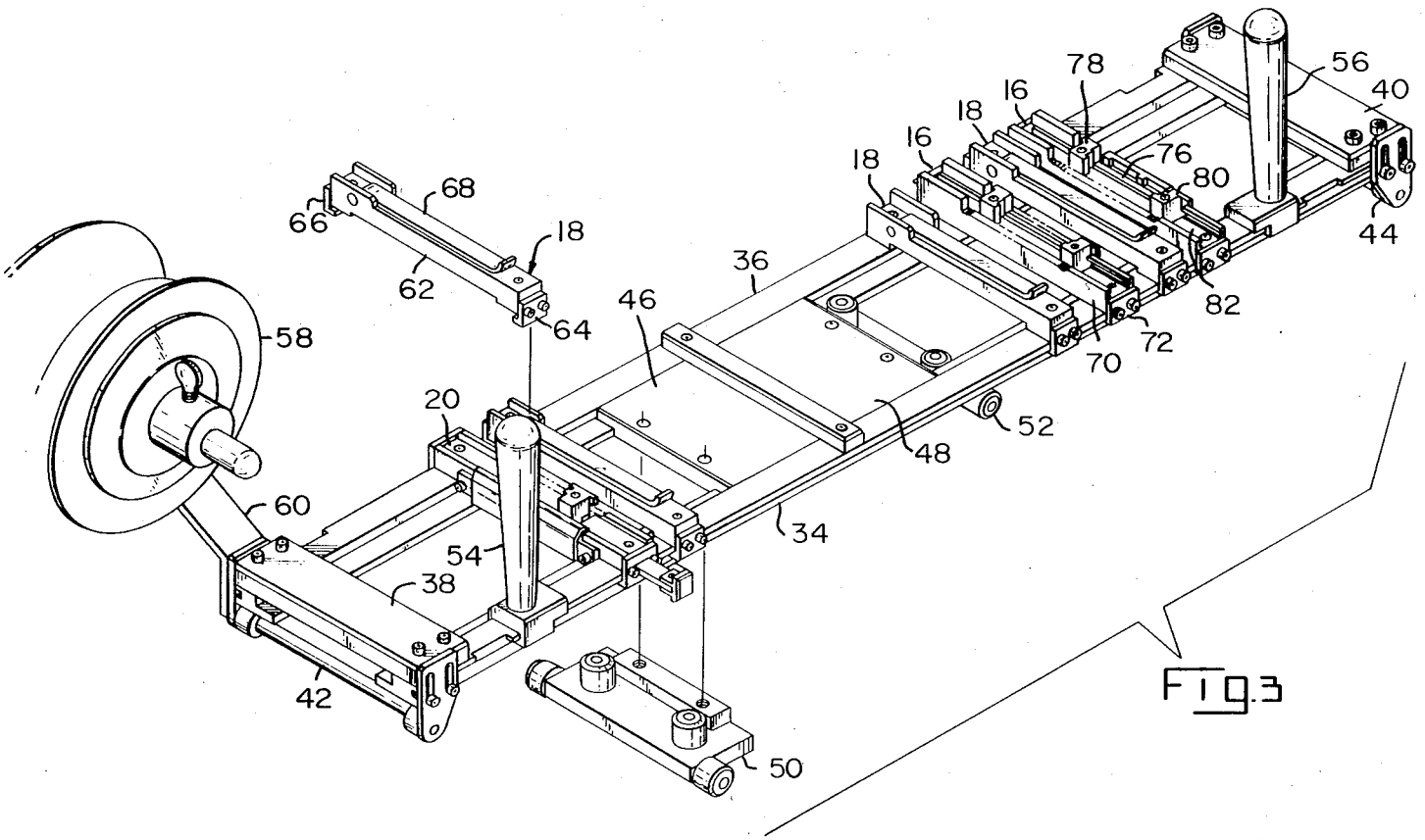
FIG. 3 is a perspective view of the index frame with portions exploded therefrom.

Referring to FIG. 3, the index frame 14 includes a pair of side rails 34, 36 joined at opposite ends by cross bar assemblies 38, 40 which include support roller assemblies 42, 44. Intermediate cross bar assemblies 46, 48 also include roller assemblies 50, 52 which not only serve to support the index frame 14 relative to the surface 28, but to guide it for transverse movement relative to the press assembly 12. Handles 54, 56 are provided at opposite ends of the side rail 34. A cable spool 58 can be supported on one end of index frame 14 by bracket 60. The connector carrying fixtures 16, 20 and clamp fixtures 18 are individually mounted on the index frame between the side rails 34, 36. Each clamp fixture 18 has an elongated body member 62 provided at each end with a rail gripping means 64, 66 and a spring biased cable clamp 68 rotatably mounted by one end to normally lie biased against the body member.

Each connector carrying fixture 16 is somewhat similar to the cable clamps in that it has an elongated body 70 with side rail gripping means 72, 74, at opposite ends thereof, with the latter provided with the previously mentioned detent 32. Each fixture 16 also includes a connector receiving recess 76 defined by a pair of adjustable guide members 78, 80 movable within channel 82 of the body 70.

Figure 4:
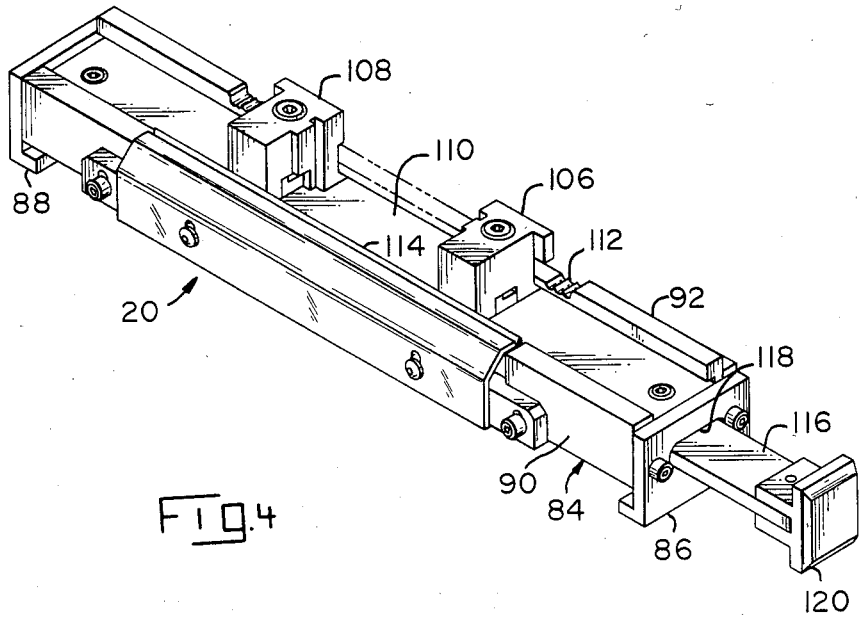
FIG. 4 is a perspective view of a connector carrying fixture equipped with a cable cutting mechanism.
Figure 5:
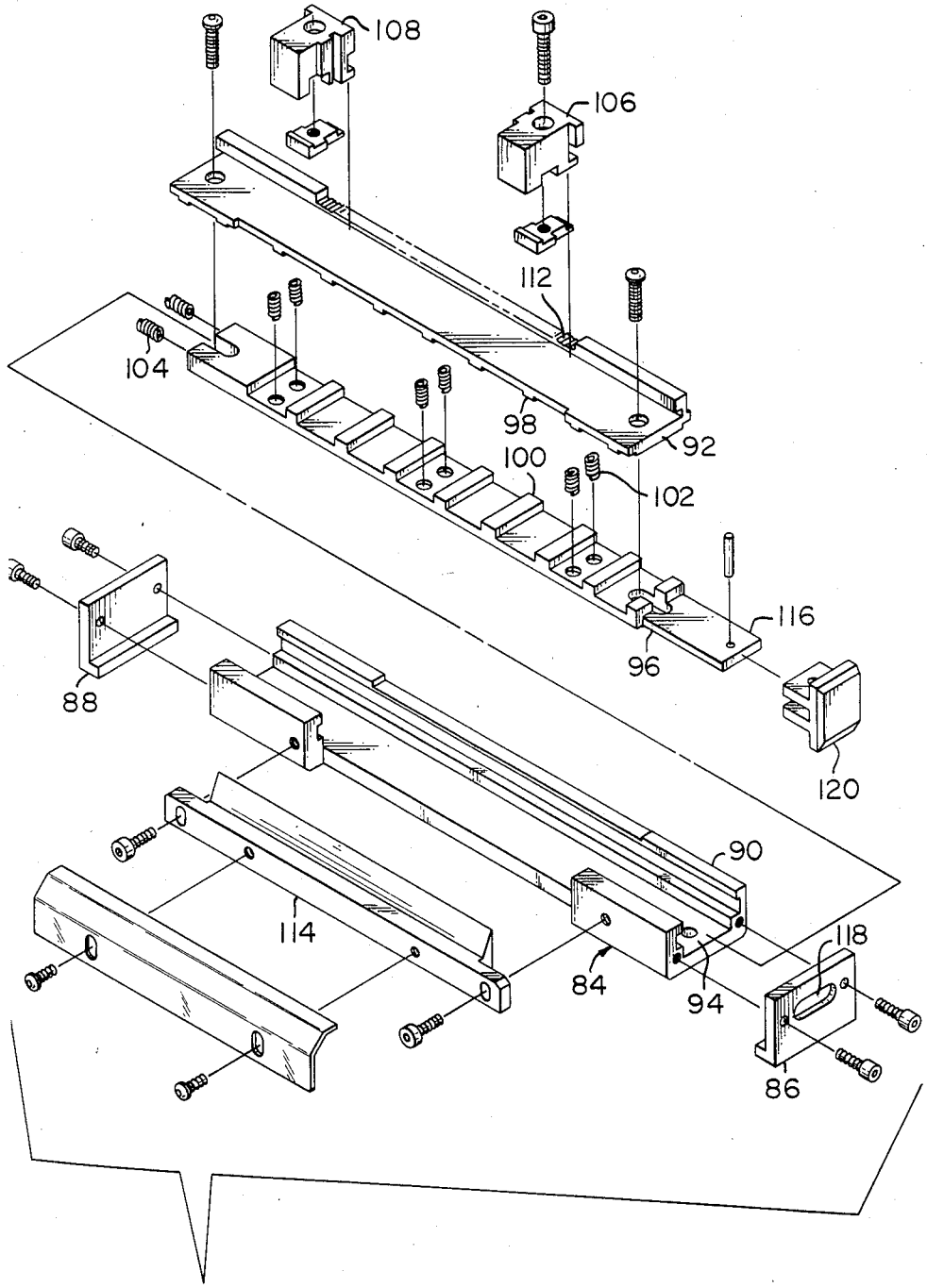
FIG. 5 is an exploded perspective view of the connector carrying fixture of FIG. 4.

Referring to FIGS. 4 and 5, the connector carrying and cable cutting fixture 20 includes an elongated body member 84 having rail gripping means 86, 88 fixed to opposite ends thereof. The body member 84 is formed by a channel shaped base 90 and cover plate 92 defining a cavity 94 in which back up plate 96 is movably mounted. Plate 92 and back up plate 96 are each provided with a plurality of integral projections 98, 100 respectively. The plate 92 and back up plate 96 are mounted in cavity 94 separated by spring means 102 and biased by spring means 104 so that projections 98, 100 are normally aligned. Plate 92 is also provided with adjustable connector guide members 106, 108, which define a connector receiving recess 110 therebetween. An edge of plate 92 can have a cable gripping profile 112. A cutter blade 114 is secured to the base 90 parallel to an aligned edge of the plates 92, 96 and in position to engage the cable 26. The back up plate 96 has an end portion 116 which extends through aperture 118 in gripping means 86 and is provided with a handle 120.

Figure 6:
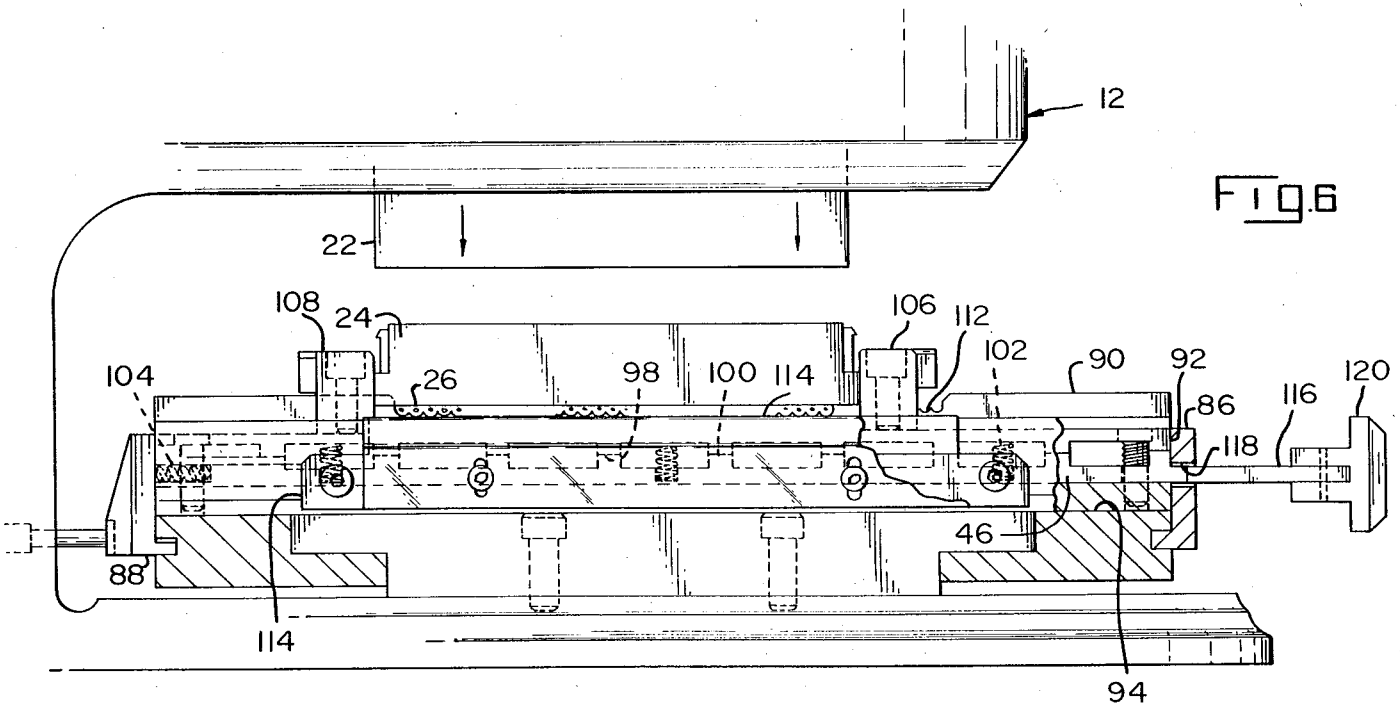
FIG. 6 is a transverse view, partially in section, of the indexing frame and connector carrying fixture of FIGS. 4 and 5 positioned beneath the ram of the press.
Figure 7:
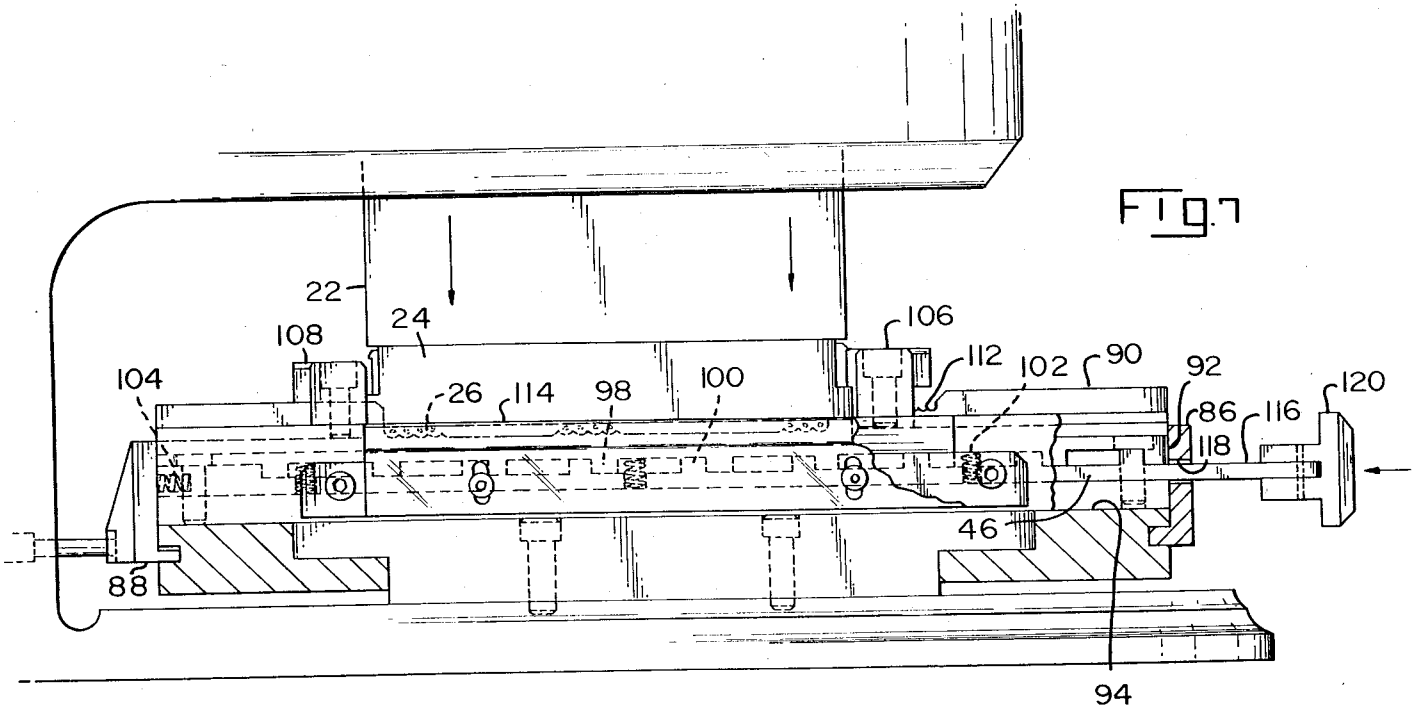
FIG. 7 is a view similar to FIG. 6 showing the ram actuated and the fixture in the cable cutting condition.

In practice, plurality of fixtures 16, 20 and clamps 18 are mounted on the index frame 14 at the desired positions for forming a cable harness. Connectors 24 are placed in the respective fixtures 16, 20 and a cable 26 is threaded through the connectors 24 between the covers and the terminal carrying bases. The cable 26 is held in position between the respective connectors 24 by the clamping fixtures 18. The index frame 14 is then sequenced beneath the ram 22 of the press assembly 12, which is actuated each time the alignment pin 30 enters a respective detent 32. This terminates a connector 24 to the cable 26. In the unactuated condition the fixture 20 will act like the other fixtures 16 and the cable 26 will be terminated but not severed. This is because the projections 98 on cover plate 92 are aligned with projections 100 on back up plate 96, as shown in FIG. 6, and prevent downward travel of plate 92 and cable 26 relative to blade 114. In order to cut the cable 26 at the end of the last connector 24 to form a complete harness, it is necessary to actuate the cutting mechanism. This is done by depressing the handle 120 in the direction of the arrow in FIG. 7 to move back up plate 96 transversely with respect to the cover plate 92 against the bias of springs 104 so that the projections 98, 100 are no longer in alignment. Descent of the ram 22 will cause the connector 24 to be terminated and the cable 26 to be driven downwardly against the blade 114 and severed in a single motion.

We claim:

1. A cable harness assembly apparatus comprising:

a press defining a workstation and having a vertically actuated termination ram at said workstation; and an index frame moveable transversely through said workstation and carrying a plurality of connector receiving fixtures adjustably spaced therealong, at least one of said connector carrying fixtures having selectively actuable cable cutting means which, when actuated, severs the cable by descent of the ram during termination of the cable.

2. A cable harness assembly apparatus according to claim 1 wherein said index frame comprises:

a pair of parallel spaced side rails and at least two end cross bar members secured to said side rails holding them in their spaced condition, said cross bar members having means to support said index frame for movement through said workstation.

3. A cable harness assembly apparatus according to claim 2 wherein each said connector receiving fixture comprises:

a body member;

gripping means to adjustably secure said body member between said side rails; and guide means adjustably secured to said body member to define a connector receiving cavity therebetween.

4. A cable harness assembly apparatus according to claim 3 wherein said at least one of said connector carrying fixtures having cable cutting means comprises:

a body member defining a channel and having a cutting blade secured extending along one sidewall of said channel, a cover plate and a backup plate mounted in said channel, each plate having a plurality of integral projections directed toward the other of said plates, first spring means normally biasing said plates apart, second spring means normally biasing said backup plate to align the projections thereof with the projections of said top plate whereby relative movement of the cover plate to the cutting blade is prohibited, movement of said back up plate against the bias of said second spring means moving said projections to a non-aligned condition allowing relative movement of said cover plate to said cutting blade whereby said cable is severed.

5. A cable harness assembly according to claim 4 further comprising:

guide means adjustably secured to said cover plate and defining a connector receiving cavity therebetween.

6. A cable harness assembly apparatus according to claim 2 wherein each said cable clamping fixture comprises:

a body member;

means to mount said body member between said side rails; and resilient means mounted by one end to normally lie against said body means in a loaded condition.

7. A cable harness assembly means according to claim 1 further comprising:

means to sense positioning of a connector receiving fixture in said workstation and allow said ram to be actuated.

8. In combination with a cable harness assembly apparatus, a connector carrying and cable cutting fixture comprising:

an elongated channel shaped body member;

a cutting blade secured to said body member forming at least a portion of one sidewall thereof;

an elongated cover plate and an elongated back up plate mounted in juxtaposition in said channel, each said plate having a plurality of integral projections directed toward the other of said plates;

first spring means between and normally biasing said cover and backup plates apart;

second spring means acting between said body member and said back up plate to normally bias said back up plate to a position in which said projections are aligned preventing relative movement of said cover plate with respect to said cutting blade, whereby movement of said back up plate against said second spring means brings said projections to a non-aligned position and allows relative movement of said cover plate to bring a cable into cutting engagement with said cutting blade.

9. The fixture according to claim 8 further comprising:

guide means adjustably secured to said cover plate and defining a connector receiving cavity therebetween.

10. The fixture according to claim 8 further comprising:

means sensing positioning of one of said fixtures in said workstation.

11. The fixture according to claim 8 further comprising means adjustably securing said fixture to indexing means movable through said cable harness assembly apparatus.

12. A cable harness assembly apparatus as in claim 1 further comprising a plurality of cable clamping fixtures on said indexing frame between respective pairs of connector carrying fixtures.

13. A cable harness assembly as in claim 1 wherein each connector receiving fixture further comprises first indexing means cooperable with second indexing means on said workstation to cause the termination ram to descend when a fixture is there.

* * * * *